US007455084B2

(12) United States Patent
Ahn et al.

(10) Patent No.: US 7,455,084 B2
(45) Date of Patent: Nov. 25, 2008

(54) SEAL OPENING DEVICE AND APPARATUS CONTAINING SAME

(76) Inventors: Benjamin J. Ahn, 855 Goddard Ave., Zanesville, OH (US) 43701; Patrick J. Moore, II, 8420 Clay Pike, Chandlersville, OH (US) 43727

( * ) Notice: Subject to any disclaimer, the term of this patent is extended or adjusted under 35 U.S.C. 154(b) by 87 days.

(21) Appl. No.: 11/353,829

(22) Filed: Feb. 14, 2006

(65) Prior Publication Data

US 2007/0186746 A1 Aug. 16, 2007

(51) Int. Cl.
*B65B 1/04* (2006.01)
*B26D 5/08* (2006.01)

(52) U.S. Cl. ..... 141/329; 141/165; 83/578; 83/946

(58) Field of Classification Search ..... 141/1, 141/86, 165, 329; 83/578, 946; 222/80–82
See application file for complete search history.

(56) References Cited

U.S. PATENT DOCUMENTS

| | | | | | |
|---|---|---|---|---|---|
| 23,196 | A | | 3/1859 | Eraser | |
| D50,278 | S | | 2/1917 | Mendenhall | |
| 1,377,805 | A | | 5/1921 | Clear | |
| 1,528,157 | A | | 3/1925 | Leyden | |
| 2,058,925 | A | * | 10/1936 | Emerson | 141/330 |
| 2,067,554 | A | * | 1/1937 | Vahle | 141/330 |
| 2,319,947 | A | | 5/1943 | Oswood | |
| 2,693,249 | A | * | 11/1954 | Baumbach | 184/105.1 |
| 2,761,210 | A | * | 9/1956 | Chun | 30/446 |
| 2,882,599 | A | | 4/1959 | Martin | |
| 3,117,374 | A | * | 1/1964 | Langner | 30/446 |
| 3,673,904 | A | | 7/1972 | Cooper et al. | |
| 3,783,724 | A | | 1/1974 | Uhlig | |
| 3,927,506 | A | | 12/1975 | Abd-Alla | |
| 4,396,340 | A | * | 8/1983 | Clinton | 414/412 |
| 4,561,567 | A | * | 12/1985 | Wittstein et al. | 222/83.5 |
| 5,220,947 | A | * | 6/1993 | Cauquil et al. | 141/91 |
| 6,390,155 | B1 | * | 5/2002 | Nguyen | 141/330 |
| 2003/0029294 | A1 | | 2/2003 | Lay et al. | |

FOREIGN PATENT DOCUMENTS

| | | |
|---|---|---|
| JP | 2000-306868 | 3/2000 |

* cited by examiner

*Primary Examiner*—Timothy L Maust
(74) *Attorney, Agent, or Firm*—Dicke, Billig & Czaja, PLLC

(57) ABSTRACT

The invention described herein provides a seal opening device structured as a component of an automated system that ruptures seals from sealed containers. The invention is particularly useful within the context of a repackaging process where automated opening of laminated and/or foil seals is needed, such as repackaging pharmaceutical or nutritional supplement products and combining their contents into larger containers or bottles. The seal opening device comprises a generally elongated and substantially planar blade wherein the distal portion of the blade forms a generally chevron configuration. The distal end of the blade further comprises an arcuate bend initiating at a position proximal to the apex tip and continuing to the tip. The invention further provides an automated seal opening apparatus structured to rupture seals from container openings comprising the seal opening device. The invention further includes an automated method of opening a seal of a sealed container utilizing the seal opening device.

12 Claims, 7 Drawing Sheets

SEAL OPENING DEVICE AND APPARATUS CONTAINING SAME

FIELD OF THE INVENTION

The invention relates to the pharmaceutical field. In particular, the invention pertains to the manufacturing, packaging and distribution industry.

BACKGROUND OF THE INVENTION

In certain industries such as pharmaceutical wholesale and distribution, repackaging of products manufactured by other companies is sometimes desired. When obtaining smaller unit products in multiple corresponding small containers, repackaging can be performed in order to combine smaller volume units into fewer and larger higher volume units for distribution and sale. In these circumstances, there may be facilities where multiple smaller volume sealed containers are received, which are then opened and the contents combined into lager containers for shipment.

Currently, the opening of multiple smaller containers in order to combine their contents can be performed using manual techniques and equipment. In particular, when sealed containers, such as foil-sealed plastic require transfer and repackaging of contents, bottles, this function is often performed manually. One problem associated with manual techniques is that they are time-consuming and cumbersome, and typically a repetitive and tedious task for an individual to perform. Another disadvantage of manual techniques is that the opening of the containers is lacking consistency and introduces variation and aberration possibilities into the repackaging process.

There is a need in the packaging field for improved repackaging techniques. Furthermore, there is a need in the pharmaceutical repackaging field for improved devices capable of automated, consistent, and efficient opening sealed containers.

SUMMARY OF THE INVENTION

The invention provides a seal opening device structured as a component of an automated system that ruptures seals from sealed containers. The invention is particularly useful within the context of a repackaging process where automated opening of laminated and/or foil seals is needed, such as repackaging pharmaceutical or nutritional supplement products and combining their contents into larger containers or bottles.

The invention provides a seal opening device structured for rupturing seals from sealed container openings, the device comprising: a generally elongated and substantially planar blade having a longitudinal axis, a proximal end and a distal end, and a first planar surface and a second planar surface on opposing sides of the blade. The blade defines an outer perimeter shared by said first and second planar surfaces, wherein the portion immediately adjacent the perimeter of the first planar surface further comprises a beveled edge. The distal end of the blade has a curved first edge and a curved second edge located on opposing sides and converging to form a pointed apex tip. The distal portion of the blade forms a generally chevron configuration. The distal end of the blade further comprises an arcuate bend initiating at a position proximal to the apex tip and continuing to the tip.

The invention further provides an automated seal opening apparatus structured to rupture seals on container openings. According to the invention, the apparatus comprises the seal opening device as a component along with a automated components, including a control mechanism for moving the device in interactive relation to a sealed container, the device being associated with the control mechanism. Further, the apparatus can comprise a positioning mechanism for moving the containers into alignment with the device.

Also, the invention provides a corresponding automated method of opening a seal of a sealed container comprising bringing a sealed container into alignment with the seal opening device and causing movement of the device into contact with the seal of the container so as to puncture and tear open the seal.

BRIEF DESCRIPTION OF THE DRAWINGS

The invention is further illustrated by the following figures—none of which are to necessarily be construed as imparting limitations to specific embodiments of the invention.

DETAILED DESCRIPTION OF THE INVENTION

In general, the seal removal device of the invention can be used in repackaging or other facilities where removal of a seal is needed. The device of the invention is structured to operate as a component of an automated system, thereby performing a seal opening function heretofore performed manually. The invention is particularly useful within the context of pharmaceutical or nutritional supplement industries where smaller containers are received and the contents transferred to a larger volume container, i.e., repackaged. In such repackaging facilities, larger number of relatively small containers are provided in sealed condition using laminated and/or foil seals adhered to the rim of the container opening. The seals are ruptured in order to open the containers and allow the contents of each container to be transferred.

The seal opening device of the invention is structured to puncture and peel back the seals while maintaining attachment of a portion of the seal on the container opening. Thus, the seal refuse can be controlled using the invention and reduce the presence of discarded seal mess. Further, the seals are rapidly opened in a substantially consistent manner that presents an opened container ready for content transfer, thereby improving the efficiency of the container-opening function, i.e., container openings per unit time. The device is particularly useful to open containers having circular openings sealed with laminated foil seals. Another advantage of the seal opening device is that it reduces damage to the plastic container by virtue of its structure, configuration and function, thereby reducing the likelihood of contamination of the contents with scrapings or shavings of the container material.

Figure 3:
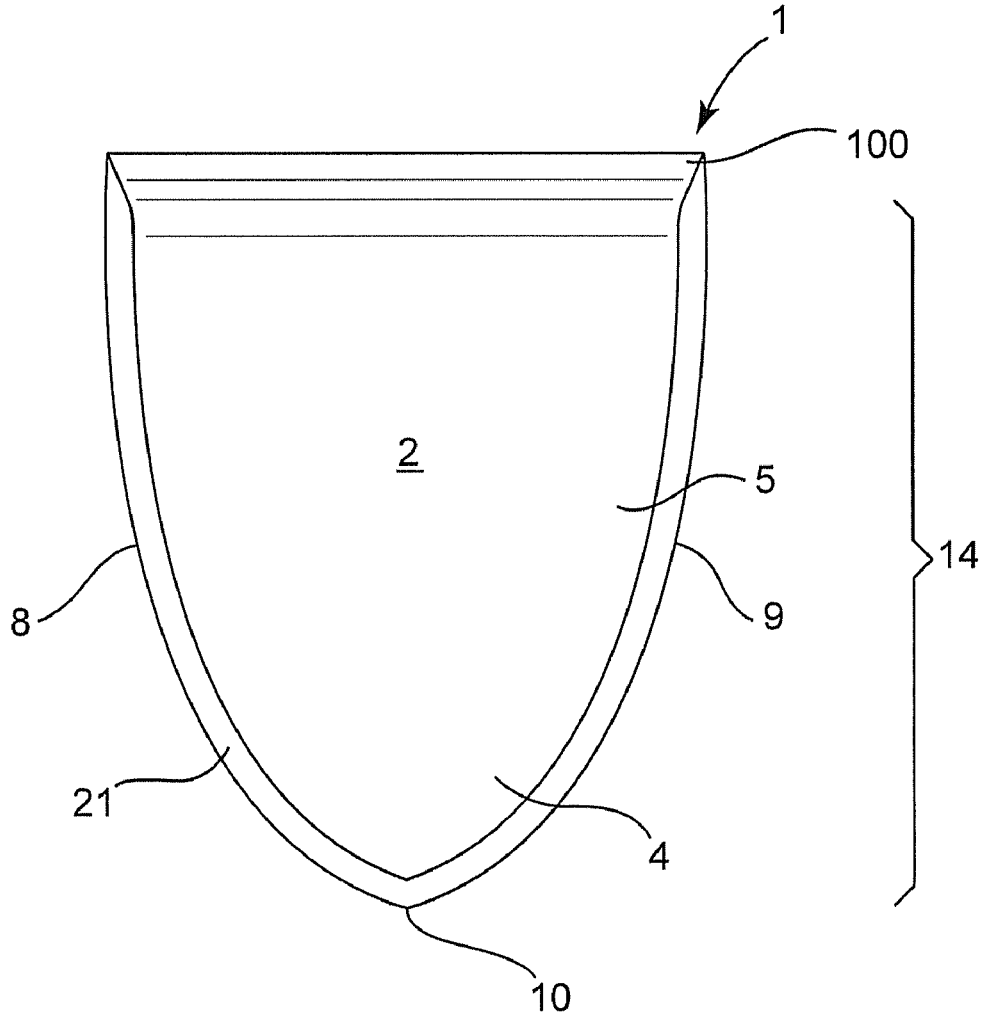
FIG. 3 is a front planar view of the blade portion of the seal opening device according to one embodiment of the invention.
Figure 4:
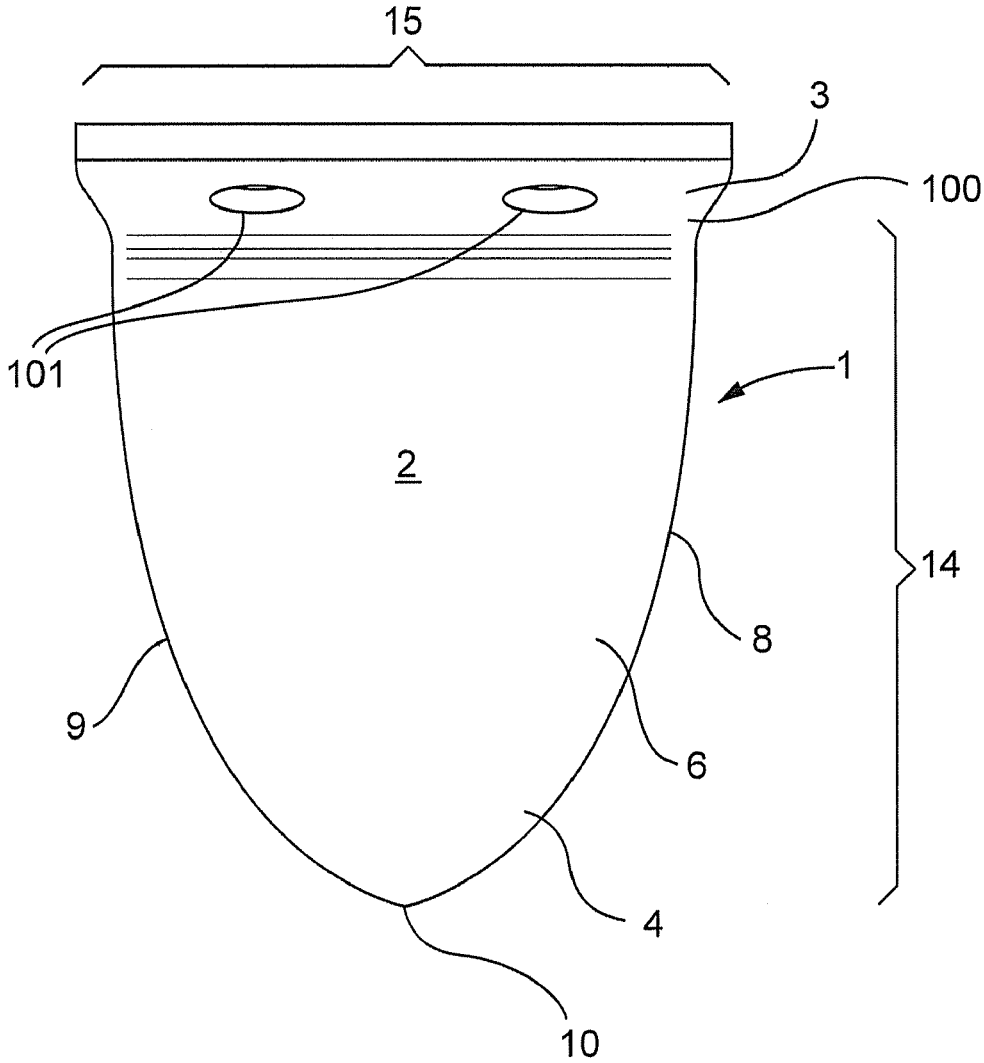
FIG. 4 is a back planar view of the seal opening device according to one embodiment of the invention.
Figure 5:
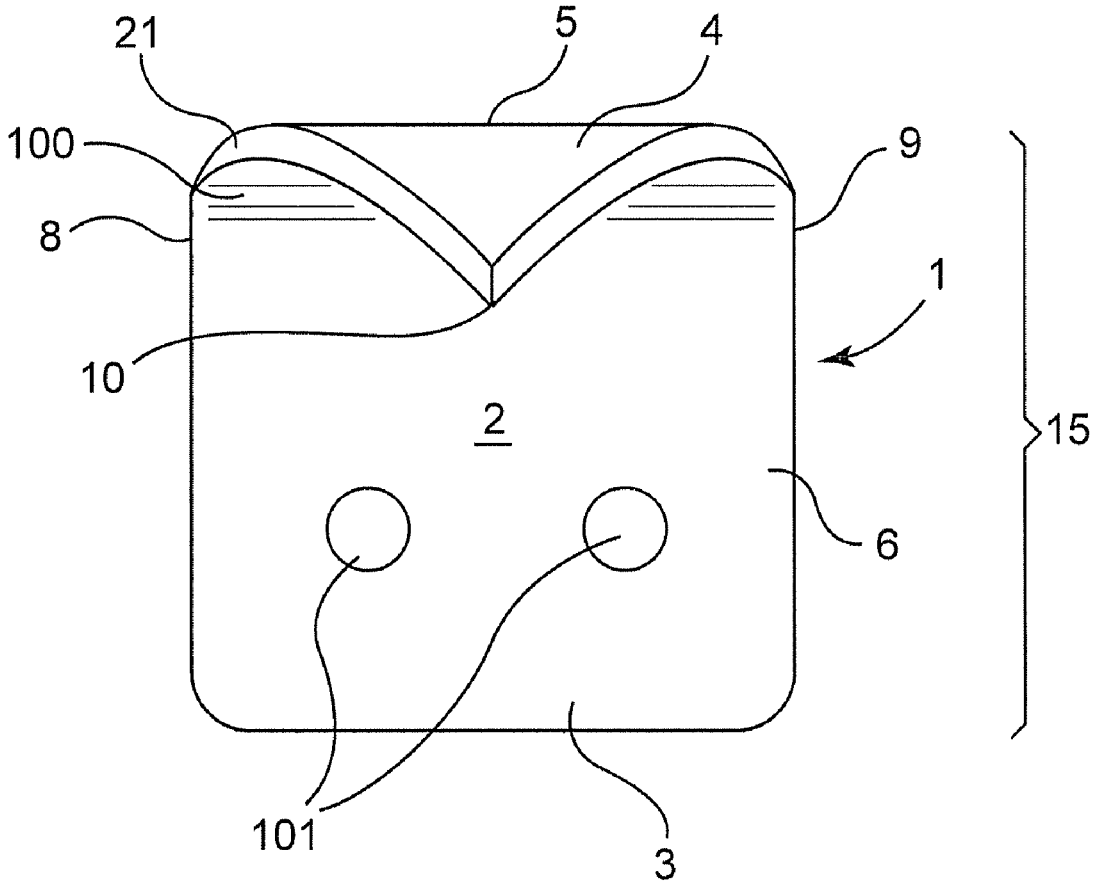
FIG. 5 is a bottom view of the seal opening device according to one embodiment of the invention.

Referring now to FIGS. 1 through 5, the seal opening device 1 of the invention comprises an elongated generally flat blade body 2 having a longitudinal axis α (see FIG. 1), a proximal end 3 and a distal end 4, first planar surface 5 and a second planar surface 6 on opposing sides of the blade 2. The blade 2 comprises an outer perimeter 7 shared by said first and second planar surfaces (5 and 6 respectively) that defines a chevron shape, i.e., the distal portion 14 of the blade 2 has a first edge 8 and a second edge 9 located on opposing sides of the blade 2 and curving inward to converge forming a pointed tip 10 as shown in FIG. 3.

Figure 1:
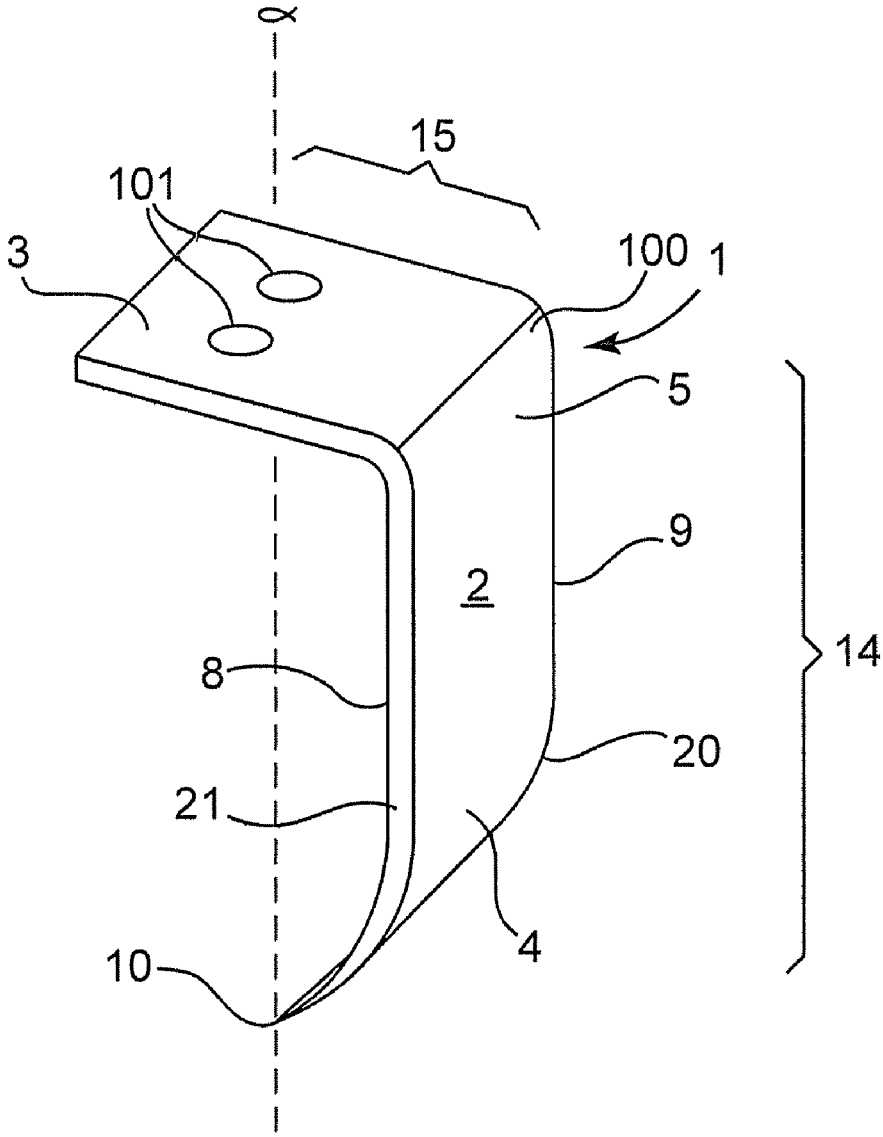
FIG. 1 is an angled side view of the seal opening device according to one embodiment of the invention.
Figure 2:
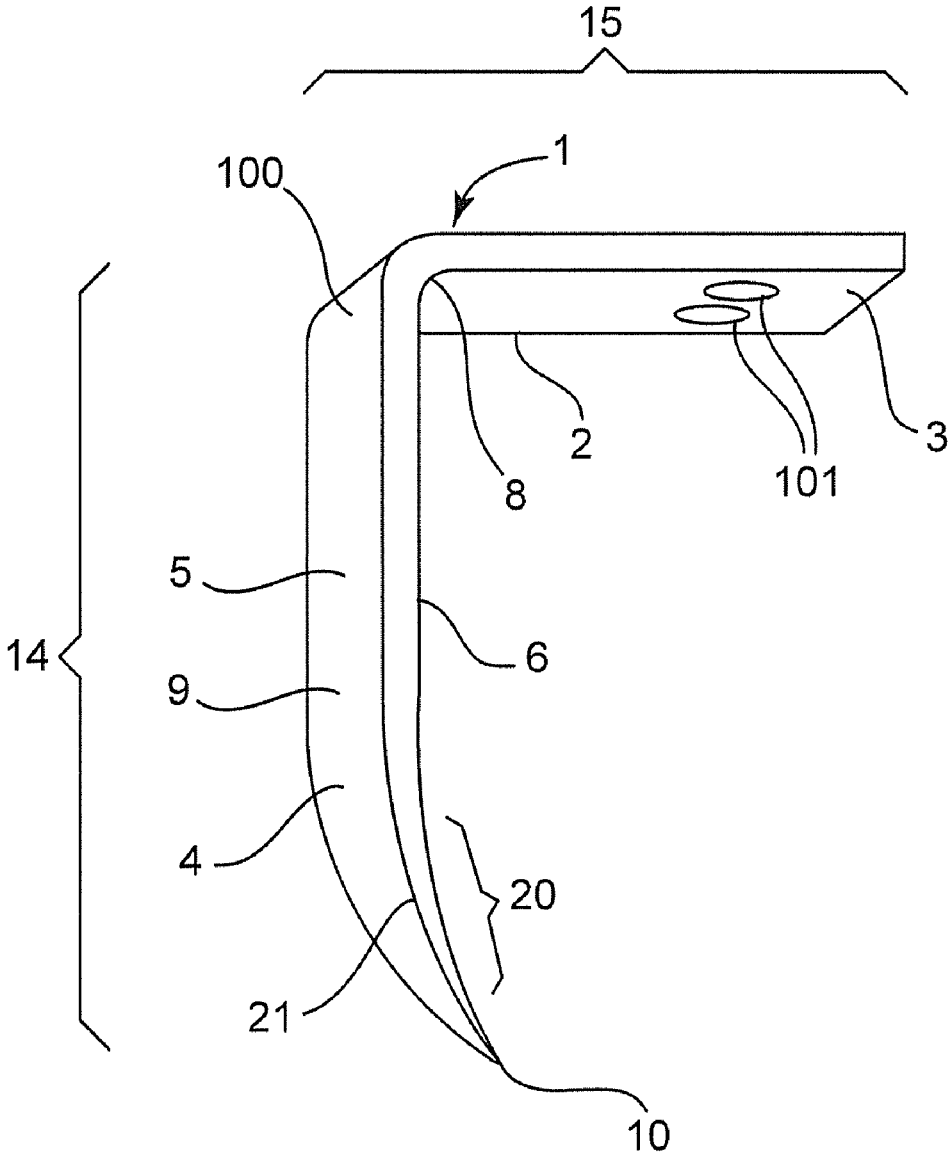
FIG. 2 is a side view of the seal opening device according to one embodiment of the invention.

Referring now to FIGS. 1 and 3, the distal portion 14 of the blade 2 comprises an arcuate bend 20 relative to its longitudinal axis α that initiates at a location proximal to the tip and continues to terminate at the tip 10. Thus, the second planar surface 6 curves inward and is concave, wherein the opposing first planar surface 5 is convex. In operation, the second planar surface 6 (concave) is oriented to face the approach of the sealed container 60 and initiates the puncture of the seal 61 (see FIGS. 6 and 7, for example). The perimeter or edges of the first planar surface further comprise a beveled region 21, which interacts with the rim of the container opening 50. In a preferred embodiment, the bevel plane has an angle of approximately 45° relative to the first planar surface 5 of the blade 2.

Figure 6A:
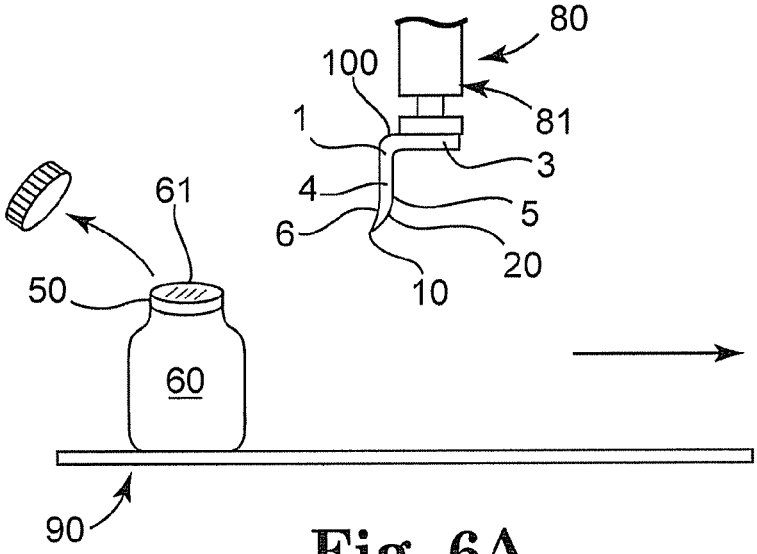
FIGS. 6A, 6B and 6C together show the sequential operation of the seal opening device as a component of a seal opening apparatus according to one embodiment of the invention.

The proximal portion 15 of the blade 2 can be constructed to facilitate attachment to an additional apparatus component that affects its movement in operation. In one embodiment as illustrated in FIGS. 1, 2, 4 and 5, the proximal portion 15 of the blade 2 can comprise a 90° bend 100 and a pair of openings 101 for screws (not shown) in order to secure the device onto a secondary structure. A reverse configuration of a 90° bend 100 is possible as well as illustrated in FIGS. 6A, B and C, as well as a proximal portion that is planar and flat without a bend (not shown). A tongue-and-slot arrangement involving the proximal portion of the blade is also possible. The seal opening device of the invention can also be attached by welding or formed as an integral portion of an apparatus component as well. A variety of removable or permanent attachment possibilities are available provided they control the movement of the seal opening device permitting its puncture-and-peel back function to occur.

The seal opening device was made according to the following process, utilizing conventional techniques and equipment readily available to those skilled in the art. In one example, an initial starting stock piece of stainless steel was used which was pre-bent 90 degrees, and ⅛" thick, with the dimensions 2" by 1". A metal band saw was used to reduce the proximal end of the piece relative to the 90 degree bend to 1 3/16" by 1" to be used for the attachment region of the device. Two ¼" holes were then drilled ⅝" apart from one another and ⅜" from the squared edge using a milling machine. Next, the distal portion of the blade was shaped using an end mill. The beveled edges were created by cutting with an electric die grinder. To form the arcuate curve at the distal portion of the device, a 20 ton hydraulic press using a bending die was used. Finally, the seal opening device was polished using a buffing wheel.

Figure 6B:
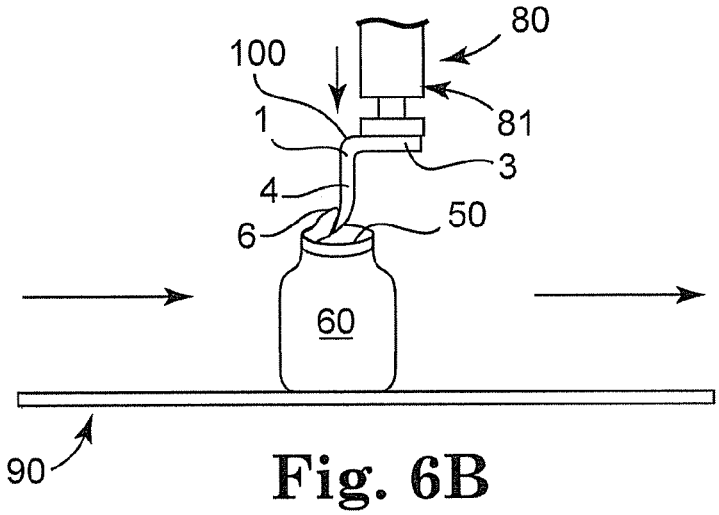
Figure 6C:
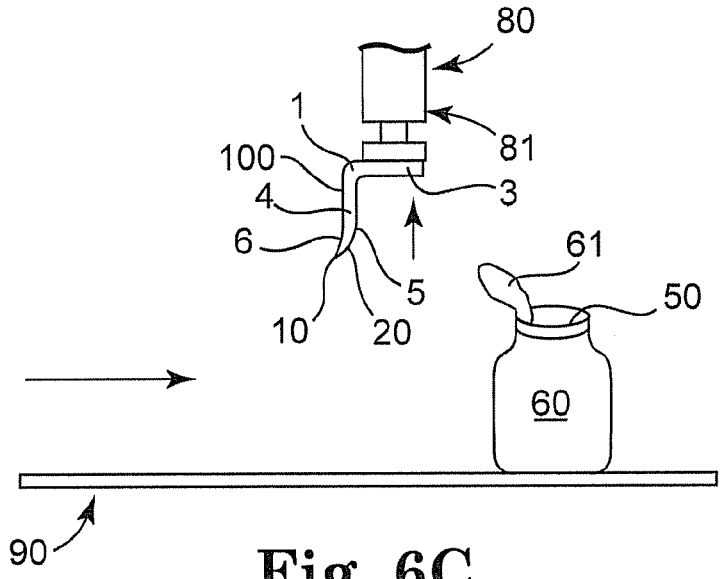
Figure 7:
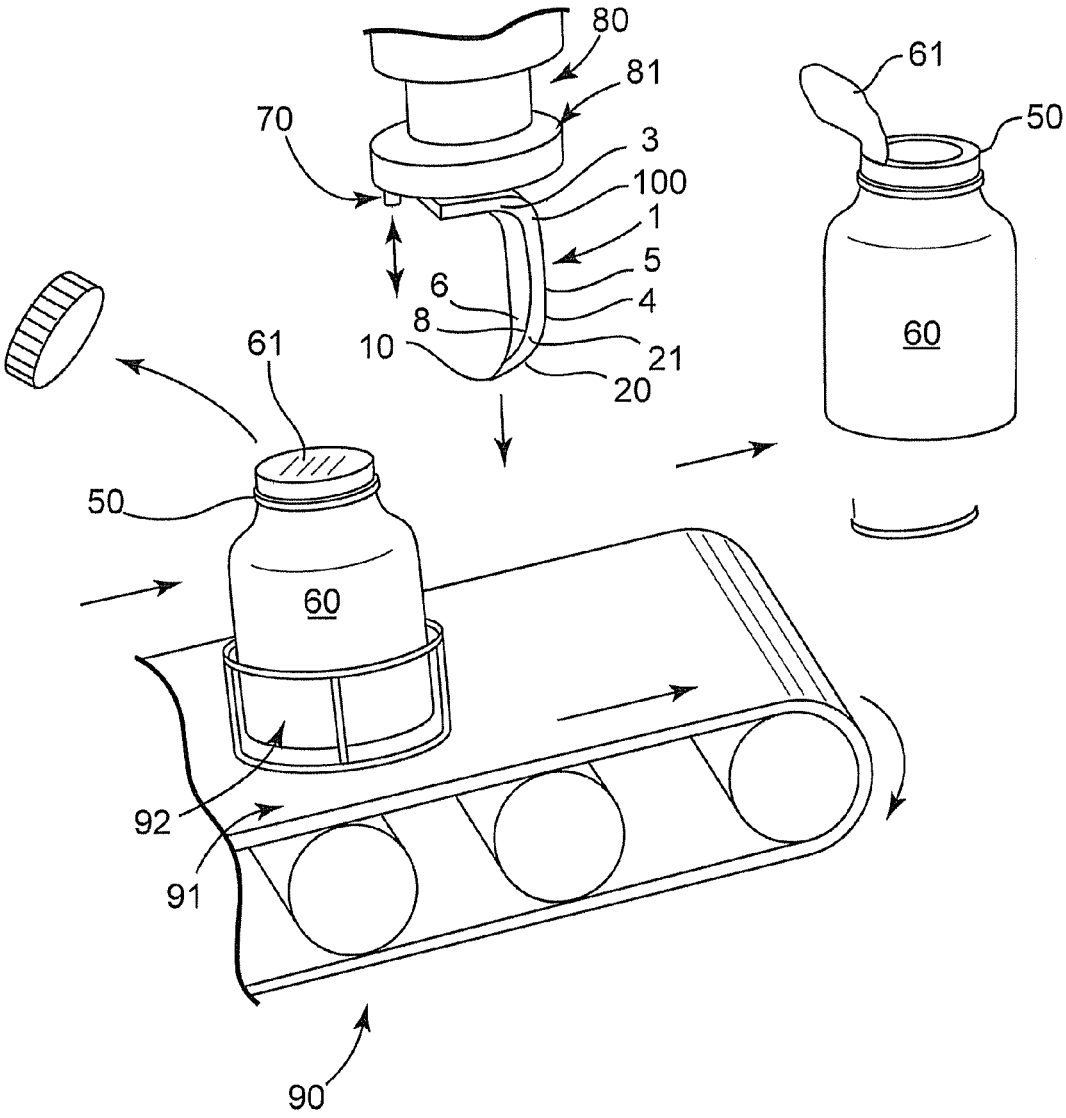
FIG. 7 is a portion of an apparatus including the seal opening device and illustrating the apparatus operation opening a sealed container, according to one embodiment of the invention.

In another aspect, the invention includes an automated seal opening apparatus structured to rupture and flap or "peel back" seals from sealed openings of containers comprising the seal opening device. An apparatus according to the invention is shown in FIGS. 6 and 7. Generally, the device and apparatus of the invention perform an automated method of opening a sealed container. In operation and as illustrated in FIGS. 6 and 7, the apparatus brings a sealed container 60 into alignment with the seal opening device 1 (FIG. 6A), and causes movement of the device 1 into contact with the seal 61 (FIG. 6B). Thus, the seal 61 is punctured and peeled back on the opening 50 of the container 60, thereby exposing the contents of the container 60 for further processing, e.g., emptying the contents into a larger container and repackaging.

The apparatus of the invention generally comprises a control mechanism 80 and positioning mechanism 90. Control mechanism 80 functions to move the seal opening device 1 in interactive relation to the seal 61 of a container 60, wherein the seal opening device 1 is structurally and functionally associated with (e.g., attached to or integrally formed as part of) the control mechanism 80. The positioning mechanism 90 is structured to move sealed containers 60 into alignment with the seal opening device 1 and control mechanism 80. While a variety of positioning mechanisms can be sued to accomplish this function, the positioning mechanism 90 is illustrated as a gripping/conveyor system that sequentially introduces sealed containers at one end, and moves the opened containers onward at the other end.

Referring now to FIGS. 6A through C and 7, the control mechanism 80 can comprise a linear actuator 81 having the seal opening device 1 attached thereto. The linear actuator 81 can be associated with a vertical adjustment structure (not shown), which can comprise mounting the linear actuator 81 on a vertical singe mount linear bearing plate. The bearing plate slides vertically on a vertical mounted aluminum frame, and has an adjusting rod attached thereto and to an upper plate on the aluminum frame. Accordingly, the linear actuator 81 per se can be adjusted to a specific vertical distance $d_2$ in order to achieve a pre-determined desired seal puncture depth $d_1$ (see FIG. 7).

The positioning mechanism 90 of the apparatus can comprise a pair of rubber-coated gripping/conveying belts, 91 and 92, that can move at a constant speed. The gripping belts 91 and 92 are preferably centered under the linear actuator 81 of the control mechanism 80. The linear actuator 81 with the seal opening device 1 in turn is oriented perpendicular to the seal surface 61 of the sealed containers 60 that pass underneath.

In addition to the linear actuator 81 with the seal opening device 1 attached thereto, the control mechanism 80 can further comprise a photoelectric sensor 70 as a triggering device. The photoelectric sensor 70 can be in convergent mode wherein the sensing energy is concentrated at a specific focus point, such as the leading edge of a sealed container (e.g., foil-sealed plastic bottle). As the rubber-coated gripping belts 91 and 92 of the positioning mechanism 90 grip the container 60 on two sides and pass it through the apparatus, the converging photoelectric sensor 70 of the control mechanism 80 determines the initial point of the container's leading edge. The gripping belts 91 and 92 also function to position the container 60 relative to the linear actuator 81 and seal opening device 1. Preferably, the gripping belts 91 and 92 are arranged to contact the container sides as low as possible to permit unobstructed sensing of the photoelectric sensor to the upper surfaces of the containers.

In one embodiment, the gripping/conveying belts can comprise two rubber-coated timing belts measuring 65 inches long and 1 inch wide. The timing side of the belts can comprise a square-tooth ½ inch pitch style. The gripping belts can be driven by a pair of 120 Volt gear motors set at a constant speed of 26 FPM. The timing belts can run from a toothed drive sprocket around an idler pulley containing a bearing.

When the photoelectric sensor 70 is triggered by the leading edge of the container opening 50, a signal (e.g., 24 Volt DC signal) is sent to a multi-function timer (not shown). Upon application of power to the input terminals of the multi-function timer (not shown), a set of contacts transfer and the timing cycle is initiated. Then, a (24 Volt DC) solenoid opens a 2 position 4-way solenoid air valve to a first position, which provides air to the linear actuator 81.

The linear actuator 81 then moves vertically downward thereby moving the seal opening device 1 to initiate the puncture of the seal 61 adjacent the leading edge of the container opening 50 as shown in FIG. 6B. As the container (e.g., bottle) moves along its path of the travel and speed, about the first third of the seal 61 is ruptured. The length of time set on the multi-function timer (not shown) hold the linear actuator 81 in the downward position as the container 60 continues along its path, thereby horizontally rupturing about the next third of the seal 61. Finally, when the timing cycle is completed (e.g., approximately 19 milliseconds), the 4-way solenoid air valve is de-energized, and the linear actuator 81 travels upward, thereby withdrawing the seal opening device_1 from the container 60 as shown in FIG. 6C. At this point, the arcuate curved portion 20 of the seal opening device 1 "pulls" the ruptured seal 61 up thereby simultaneously rupturing the last portion of the seal 61 and "peeling" it back while still leaving a small portion of the seal 61 attached to the container opening 50.

An important aspect of the invention is that the seal 61, e.g., foil seal, is peeled back but a portion of it remains attached to the opening (i.e., rim) 50 of the container 60 (as shown in FIGS. 6C and 7). The invention avoids complete detachment of the ruptured seal and avoiding the generation of loose, detached seals at the conclusion of the process. Accordingly, the risk of mechanical interference with the machinery caused by discarded seals is reduced by the invention, as well as the creation of excessive particulate waste.

The invention has been described herein above with reference to various and specific embodiments and techniques. It will be understood, however, that reasonable modifications can be made from such embodiments and techniques without substantially departing from either the spirit or scope of the invention as defined by the following claims.

What is claimed is:

1. An automated process of opening seals on sealed containers, said process comprising the steps of:

a) positioning a sealed container in alignment with a seal opening device, said seal opening device comprising a blade having an overall chevron configuration and longitudinal axis, a proximal end and a distal end, and a first surface and a second surface on opposing sides of the blade, wherein said blade defines an outer perimeter shared by said first and second surfaces, wherein said distal end of said blade has a curved first edge and a curved second edge located on opposing sides and converging to form a pointed apex tip, and wherein said distal end of said blade further comprises an arcuate bend initiating at a position proximal to the apex tip and continuing to the tip, such that one of said first and second surfaces is concave and the other of said first and second surfaces is convex;

b) introducing said tip of said seal opening device to said seal of said sealed container thereby puncturing and peeling said seal; and c) withdrawing said seal opening device from said container;

wherein steps b) and c) include linearly moving said seal opening device along a longitudinal axis and substantially perpendicular relative to a planar surface defined by said container seal.

2. The process according to claim 1 wherein step (a) comprises sequentially positioning a plurality of sealed containers into alignment with said seal opening device.

3. The process according to claim 1 wherein said sealed containers is sealed by a foil seal.

4. The process according to claim 1 wherein step b) comprises moving said sealed container toward said seal opening device.

5. The process according to claim 4, wherein said seal opening device is positioned such that said concave surface and said apex tip are oriented toward a container approaching said seal opening device.

6. The process according to claim 1, wherein following step c), a portion of the seal as ruptured at step b) remains attached to said container.

7. An apparatus for opening a seal of a sealed container, said apparatus comprising:

a) seal opening device comprising a blade having an overall chevron configuration and longitudinal axis, a proximal end and a distal end, and a first surface and a second surface on opposing sides of the blade;

wherein said blade defines an outer perimeter shared by said first and second surfaces, wherein said distal end of said blade has a curved first edge and a curved second edge located on opposing sides and converging to form a pointed apex tip, and wherein said distal end of said blade further comprises an arcuate bend initiating at a position proximal to the apex tip and continuing to the tip, such that one of said first and second surfaces is concave and the other of said first and second surfaces is convex;

b) control mechanism for moving seal opening device into contact with and away from a seal of a sealed container; and c) positioning mechanism for moving said sealed container into alignment with said seal opening device.

8. The apparatus according to claim 7, wherein said apparatus comprises the seal opening device attached to said control mechanism.

9. The apparatus according to claim 7, wherein said control mechanism comprises a linear actuator.

10. The apparatus according to claim 9, wherein said linear actuator moves said seal opening device along a longitudinal axis perpendicular relative to a planar surface of said seal on said sealed container.

11. The apparatus according to claim 7, wherein said positioning mechanism comprises a pair of gripping belts structured to move said container relative to said control mechanism and seal opening device.

12. The apparatus according to claim 7, wherein said positioning device moves said container toward said seal opening device such that said concave surface and said apex tip are oriented toward an approaching container provided by said positioning mechanism.

* * * * *